US006290520B2

(12) United States Patent
Otsu

(10) Patent No.: US 6,290,520 B2
(45) Date of Patent: Sep. 18, 2001

(54) TELEVISION CO-VIEWING SERIES UNIT

(75) Inventor: Masahiro Otsu, Nisshin (JP)

(73) Assignee: Maspro Denkoh Co., Ltd., Aichi (JP)

( * ) Notice: Subject to any disclaimer, the term of this patent is extended or adjusted under 35 U.S.C. 154(b) by 0 days.

(21) Appl. No.: 09/788,212

(22) Filed: Feb. 16, 2001

(30) Foreign Application Priority Data

Feb. 21, 2000 (JP) ..... 12-043341

(51) Int. Cl.[7] ..... H01R 29/00
(52) U.S. Cl. ..... 439/188; 439/189; 200/506
(58) Field of Search ..... 439/188, 189, 439/535, 536, 578; 200/51 R, 506

(56) References Cited

U.S. PATENT DOCUMENTS 5,317,392 * 5/1994 Ishibashi et al. ..... 348/6
5,788,519 * 8/1998 Stern ..... 439/189
5,909,063 * 6/1999 Stillman et al. ..... 200/51 R X
6,005,497 * 12/1999 Snyder ..... 200/506 X

* cited by examiner

*Primary Examiner*—Khiem Nguyen
(74) *Attorney, Agent, or Firm*—Pearson & Pearson, LLP

(57) ABSTRACT

A series unit capable of easily changing over a undirectional state to/from a bidirectional state and easily judging which state the series unit is in, is provided. A high pass filter 9 and a changeover switch 5 are included, and an operating protrusion 5*a* of the changeover switch 5 is provided in a circular recess 10 of a panel 2 formed to surround an F-type terminal 4 provided on a front surface. A cylindrical adapter 6 inserted into the circular recess 10 is provided so as to operate the operating protrusion 5*a*. The adapter 6 has a notch 6*a* which is provided on one side portion of the adapter 6 and which does not press the operating protrusion 5*a*. By inserting the adapter 6 while rotating the adapter and changing an angle, a unidirectional state can be changed over to/from a bidirectional state. In addition, a mark 16*a* indicating a position of the operating protrusion 5*a* is provided on the panel 2 and a mark 15 indicating a notch position is provided on an end portion on a front surface of the adapter 6.

4 Claims, 7 Drawing Sheets

(a)

(b)

(a)

(b)

TELEVISION CO-VIEWING SERIES UNIT

BACKGROUND OF THE INVENTION

1. Field of the Invention

The present invention relates to a television co-viewing series unit.

2. Description of Related Art

As shown in, for example, FIG. 2, a perspective explanatory view of a television co-viewing series unit (to be simply referred to as "series unit" hereinafter) has a coaxial cable connection terminal 3 provided on a side portion or a back portion thereof and supplied with a signal from an antenna, F-type terminals 4 each provided on a front surface and connecting a connection connector (not shown) for reception for a television or the like, and a resin panel 2 arranged on a front surface thereof. The F-type terminals 4 are arranged at the center of circular recesses 10 formed in the panel 2, respectively. The series unit is used while the rear portion thereof is inserted into and attached to a switch box 12 provided in a wall surface and the front surface thereof is covered with a decorative laminated sheet 13.

The conventional series unit is intended to transmit only a unidirectional signal from a signal source such as an antenna. Recently, a bidirectional system for outputting power or a signal from a reception end has been gradually used. The bidirectional system includes a unidirectional type for cutting a signal from the reception end with a high pass filter interposed between the system and the reception end and a bidirectional type which is not provided with a filter, which types are individually formed. If the unidirectional type is changed to the bidirectional type or vice versa, a series unit main body is replaced by another, accordingly.

However, as stated above, the series unit is used while the unit is attached to the switch box 12 and the front surface of the unit is covered with the decorative laminated sheet 13. Due to this, if the series unit 1 is replaced by another, it is required to conduct laborious operations including the removal of the decorative laminated sheet 13 and that of the coaxial cable connected to the series unit 1. Further, both the unidirectional type and the bidirectional type are the same in the shape of the terminal while the unit is incorporated into the switch box 12 and attached into the wall surface. Due to this, it is impossible to judge whether the unit is the unidirectional type or the bidirectional type at a glance.

SUMMARY OF THE INVENTION

It is, therefore, an object of the present invention to provide a series unit capable of easily changing over a unidirectional state to/from a bidirectional state and easily judging whether the unit is in the unidirectional state or the bidirectional state.

To perform the above object, the invention recited in claim 1 is a television co-viewing series unit having a coaxial cable connection terminal provided on one of a rear portion and a side portion, a panel provided on a front surface, and an F-type terminal protrudingly provided in a recess formed in the panel, characterized by comprising: a high pass filter circuit; and changeover means for changing over a unidirectional state, in which the coaxial cable connection terminal and the F-type terminal are electrically connected to each other through the high pass filter circuit, to and from a bidirectional state, in which the coaxial cable connection terminal and the F-type terminal are directly connected to each other without the high pass filer circuit.

The invention recited in claim 2 is based on the invention recited in claim 1 and characterized in that the changeover means is a changeover switch having an operating protrusion on a wall surface in the recess and by inserting a generally cylindrical adapter having almost the same outer dimension as an outer dimension of the recess into the recess, the changeover switch is pressed and operational.

The invention recited in claim 3 is based on the invention recited in claim 2 and characterized in that a non-contact region, which does not press the operating protruding when the adapter is inserted into the recess, is formed on a side portion of the adapter.

The invention recited in claim 4 is based on the invention recited in claim 3 and characterized in that a mark indicating and located at a position of a front surface of the adapter near a non-contact region and a mark indicating and located at a position of a front surface of the panel near the operating protrusion are provided, respectively.

BRIEF DESCRIPTION OF THE DRAWINGS

FIGS. 8A and 8B show another shape of a panel recess and that of an adapter, wherein FIG. 8A is a front view of an F-type terminal portion and FIG. 8B is a perspective view of the adapter inserted into the recess constituting the F-type terminal portion.

DESCRIPTION OF THE PREFERRED EMBODIMENTS

Figure 2:
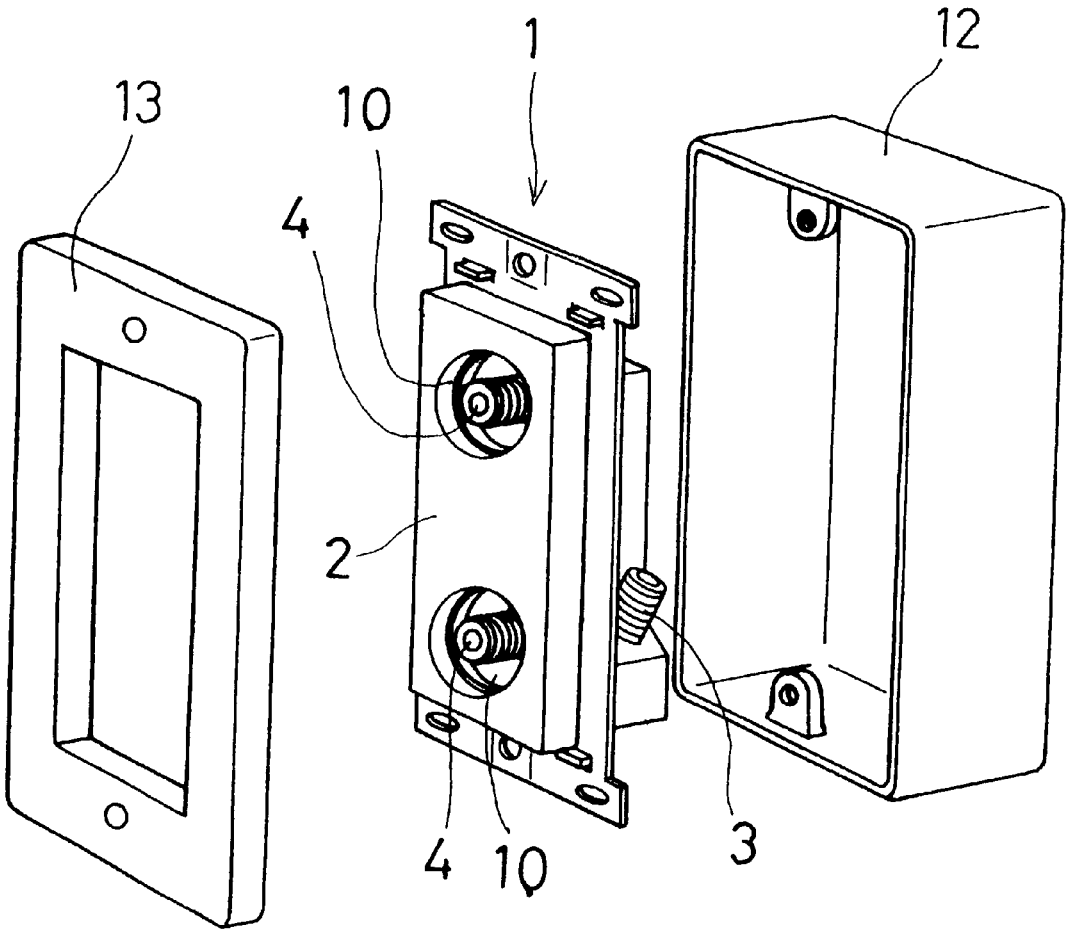
FIG. 2 is a perspective explanatory view of the series unit.

The embodiments of the present invention will be described hereinafter in detail with reference to the accompanying drawings. The overview of a series unit according to the present invention is the same as that shown in FIG. 2 and described above and the same constituent elements are denoted by the same reference symbols.

Figure 1:
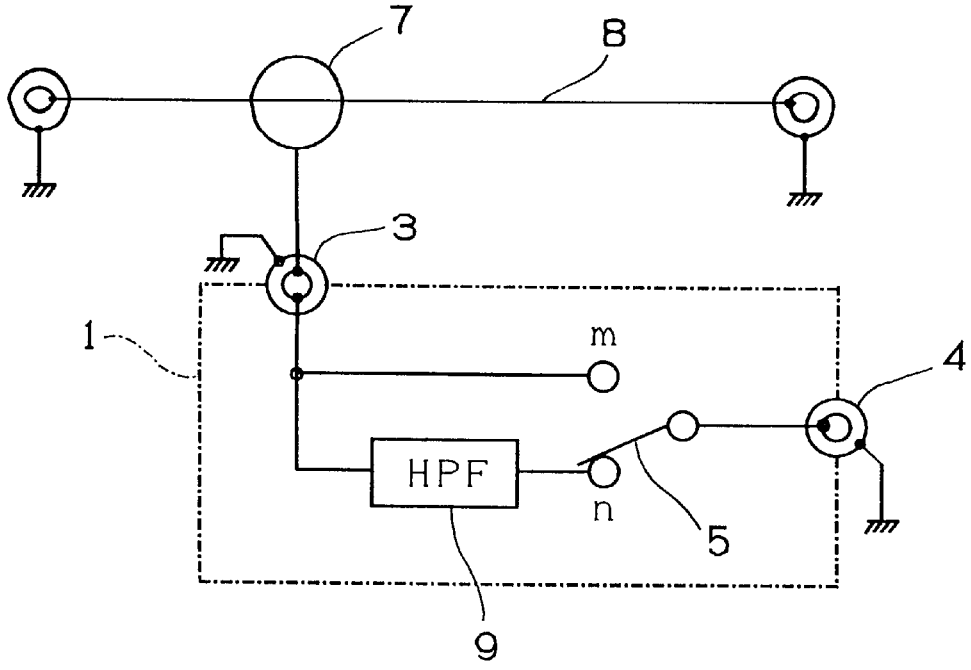
FIG. 1 is a circuit diagram of a series unit in one embodiment according to the present invention.

FIG. 1 is a circuit diagram of a series unit 1 according to the present invention. As shown in FIG. 1, an F-type terminal 4 is connected to a coaxial cable connection terminal 3 through a single-pole double-throw changeover switch 5 having contacts m and n. The coaxial cable connection terminal 3 is connected to a main cable 8 to which a signal source such as an antenna is connected, through a branch unit 7. If the changeover switch 5 is changed over, the series unit 1 can be changed over accordingly. Namely, If the changeover switch is connected to the contact m, the series unit 1 turns into a bidirectional state which is a straightforward state. If the switch 5 is connected to the contact n, the series unit 1 turns into a unidirectional state through a high pass filter 9.

Figure 3:
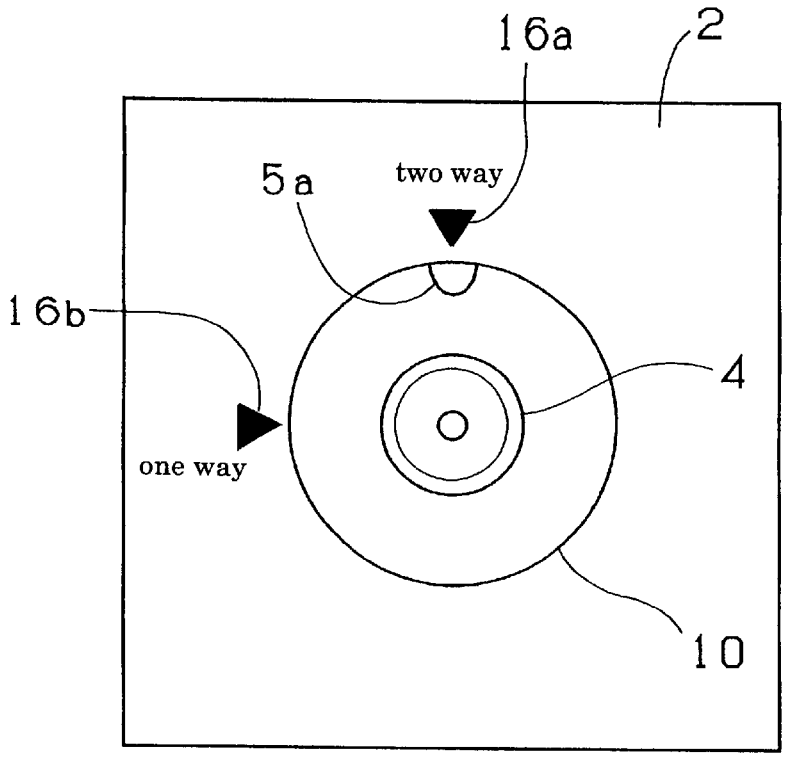
FIG. 3A is a front view of the F-type terminal portion of the series unit including the circuit shown in FIG. 1.
FIG. 3B is a perspective view of an adapter inserted into a circular recess constituting the F-type terminal portion and carrying out a switch changeover operation.
Figure 3:
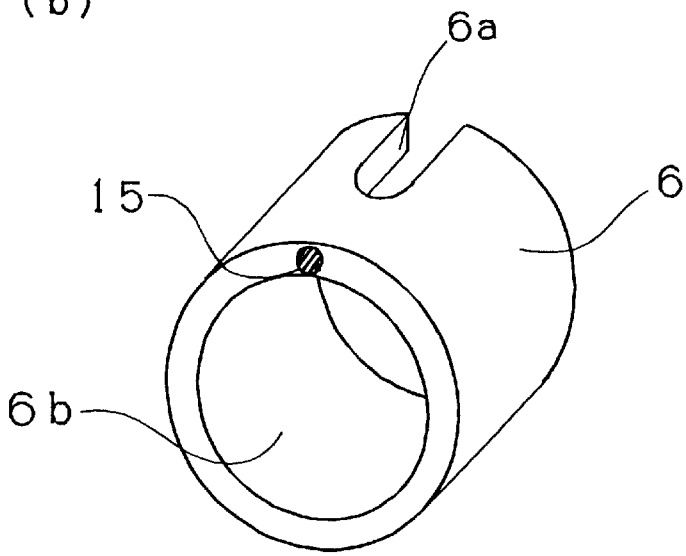

FIG. 3A is an enlarged front view of the series unit 1 in the vicinity of the F-type terminal 4 and FIG. 3B is a perspective view of an adapter 6 attached to the F-type terminal 4. In FIG. 3A, reference symbol 5*a* denotes the operating protrusion of the change overswitch 5. The operating protrusion 5*a* is formed on an upper wall surface in the circular recess 10 of a panel 2. The changeover switch 5 operates by pressing the operating protrusion 5*a* in a wall surface direction, i.e., upward in FIG. 3. The switch 5 is constituted to turn into a bidirectional state while the operating protrusion 5*a* protrudes into the circular recess 10 and to turn into a unidirectional state while the operating protrusion 5*a* is depressed. The adapter 6 is a cylindrical body having almost the same diameter as that of the circular recess 10. The adapter 6 has a circular penetrating hole 6*b* which is provided at a center thereof and into which a connection connector for a television or the like can be inserted, a notch 6*a* formed on one portion of a side surface thereof from an insertion tip end portion and having a slightly larger width than that of the operating protrusion 5*a*, and a mark 15 provided on the end portion of a front surface thereof for recognizing the position of the notch 6*a* from the front.

Further, a mark 16*a* is provided on the front surface of the panel 2 above the circular recess 10 where the operating protrusion 5*a* is located, and a mark 16*b* is provided on the side portion of the panel 2 moved from the position of the mark 16*a* by 90 degrees. Character "B" is written on the upper mark 16*a* and character "U" is written on the side mark 16*b*.

If the adapter 6 is inserted into the panel 2 while the mark 15 of the adapter 6 is matched to the upper mark 16*a* of the circular recess 10, then the operating protrusion 5*a* is not pressed, the switch 5 does not operate and the series unit 1 is kept in the bidirectional state. If the adapter 6 is inserted into the panel 2 while the mark 15 is matched to the side mark 16*b* of the circular recess 10, then the switch 5 is changed over and the series unit 1 turns into the unidirectional state.

In this way, by providing the changeover switch 5 as changeover means and conducting the changeover operation of the changeover switch 5 using the adapter 6, it is possible to easily change over the unidirectional state to/from the bidirectional state without replacing the series unit by another. Further, by changing the insertion state of the adapter 6, it is possible to change over the unidirectional state to/from the bidirectional state, the adapter 6 can be always kept attached to the series unit. Thus, there is no fear of losing the adapter 6.

Further, by providing the mark 16*a* indicating the position of the operating protrusion 5*a*, it is possible to easily recognize the position of the changeover switch 5. Also, by providing the adapter 6 with the mark 15 indicating the position of the notch 6*a* which is a non-contact region, it is possible to easily, visually grasp the state of the series unit 1 after the adapter 6 is attached to the series unit 1. Further, by providing the mark 16*b* indicating the unidirectional state in the lateral direction of the circular recess 10, a user fails to be in doubt as to in which direction the adapter 6 is to be inserted and can recognize the unidirectional or bidirectional state more easily. Besides, by writing characters indicating the states of the series unit 1 in the vicinity of the respective marks as shown in the embodiment stated above, the user can easily judge the state of the series unit 1 and conduct a changeover operation.

Figure 4:
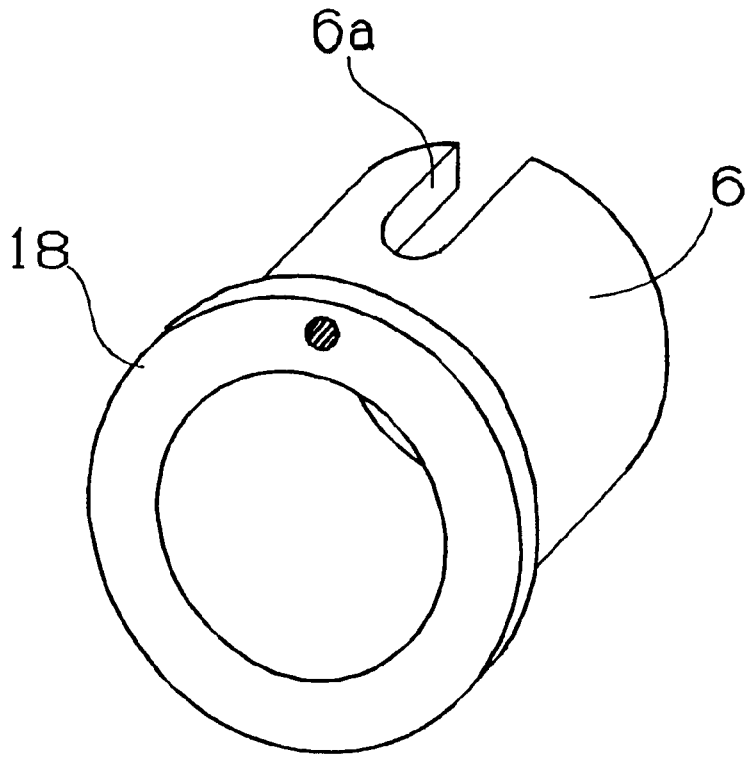
FIG. 4 shows another embodiment of an adapter.

FIG. 4 shows another shape of the adapter inserted into the circular recess 10 shown in FIG. 3A. As shown in FIG. 4, a collar portion 18 is formed on the front surface of the adapter 6 to thereby form a wider front surface. By doing so, it becomes easier to recognize the position of the notch 6*a* and the adapter 6 can be easily attached and detached to/from the series unit 1 by operating the collar portion 18.

The circular recess 10 of the series unit 1 is formed to have a larger diameter than that of the recess of the conventional series unit by as much as the thickness of the adapter 6. Each of the marks of the circular recess 10 may be formed simply as a concave or convex mark or may be formed by marking with color ink such as red ink.

Further, the unidirectional state suffices that the notch 6*a* is detached from the operating protrusion 5*a* of the changeover switch 5 and the position of the mark 16*b* should not be limited to the lateral position rotated by 90 degrees from the position of the mark 16*a* indicating the bidirectional state. Further, the adapter 6 may not be provided with the non-contact region such as the notch 6*a*. If the adapter 6 is not provided with a non-contact region and the series unit 1 is used as a bidirectional type, it is not necessary to attach the adapter 6 to the series unit 1. In addition, the polarity of the changeover switch may be opposite and the series unit may be turned into the bidirectional state by pressing and turning on the changeover switch 5. Besides, while two F-type terminals are provided in the embodiment stated above, only one F-type terminal may be provided.

Figure 5:
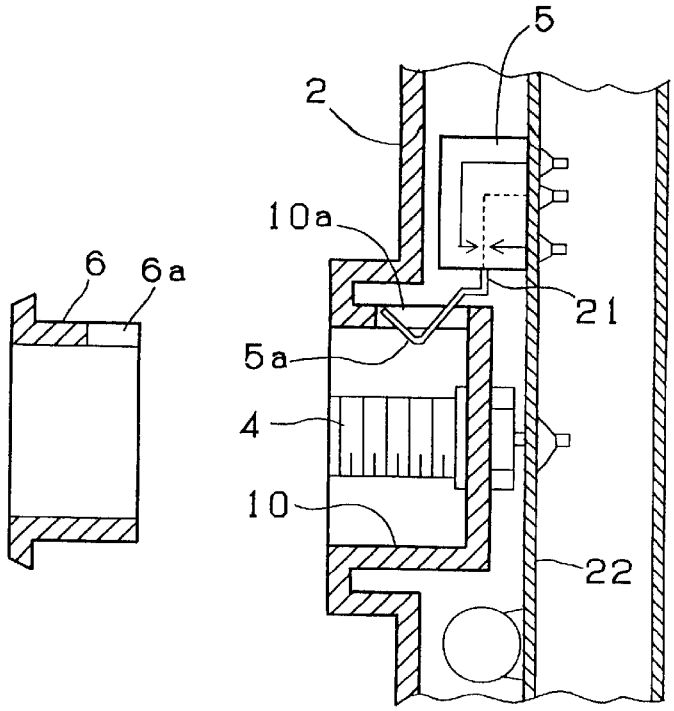
FIG. 5 is a cross-sectional view of a series unit showing a concrete example of a changeover switch and that of an operating protrusion.

FIG. 5 is a sectional explanatory view of the series unit and shows a concrete example of the operating protrusion 5*a*. The switch 5 is incorporated into an internal circuit board 22. An operating section 21 extending from the switch 5 is formed out of an elastic elongated metallic plate, bent and protruded from a window 10*a* provided on the wall surface of the circular recess 10 to thereby form the operating protrusion 5*a*. In this way, by providing the operating section 21, it is possible to press the operating protrusion 5*a* and conduct the changeover operation of the switch 5 by the insertion operation of the adapter 6.

Figure 6:
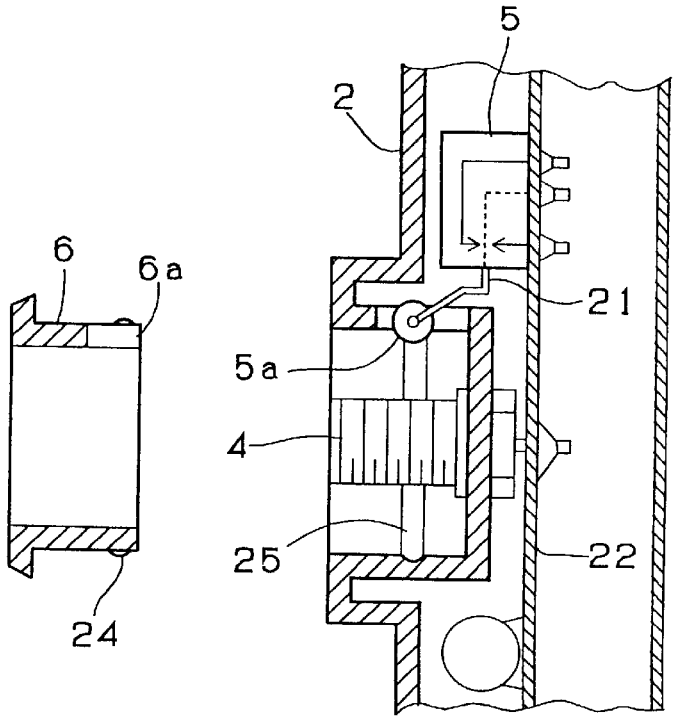
FIG. 6 is a cross-sectional view of a series unit showing another concrete example of the changeover switch and that of the operating protrusion.

Further, as shown in FIG. 6, the operating protrusion 5*a* may be formed by attaching a rotary member 23 to the tip end of the operating section 21. This can ensure smooth changeover operation.

In the example of FIG. 6, a protrusion 24 is provided around the adapter 6 and an engagement groove 25 engaged with the protrusion 24 is provided at a predetermined circular position in the circular recess 10. By providing such an engagement mechanism, the mechanism functions to prevent the detachment of the adapter 6. Thus, the adapter 6 is not loosened or detached when attaching or detaching the cable. Further, while the switch 5 is preferably for high frequency, a small-sized micro-switch may be used.

Figure 7:
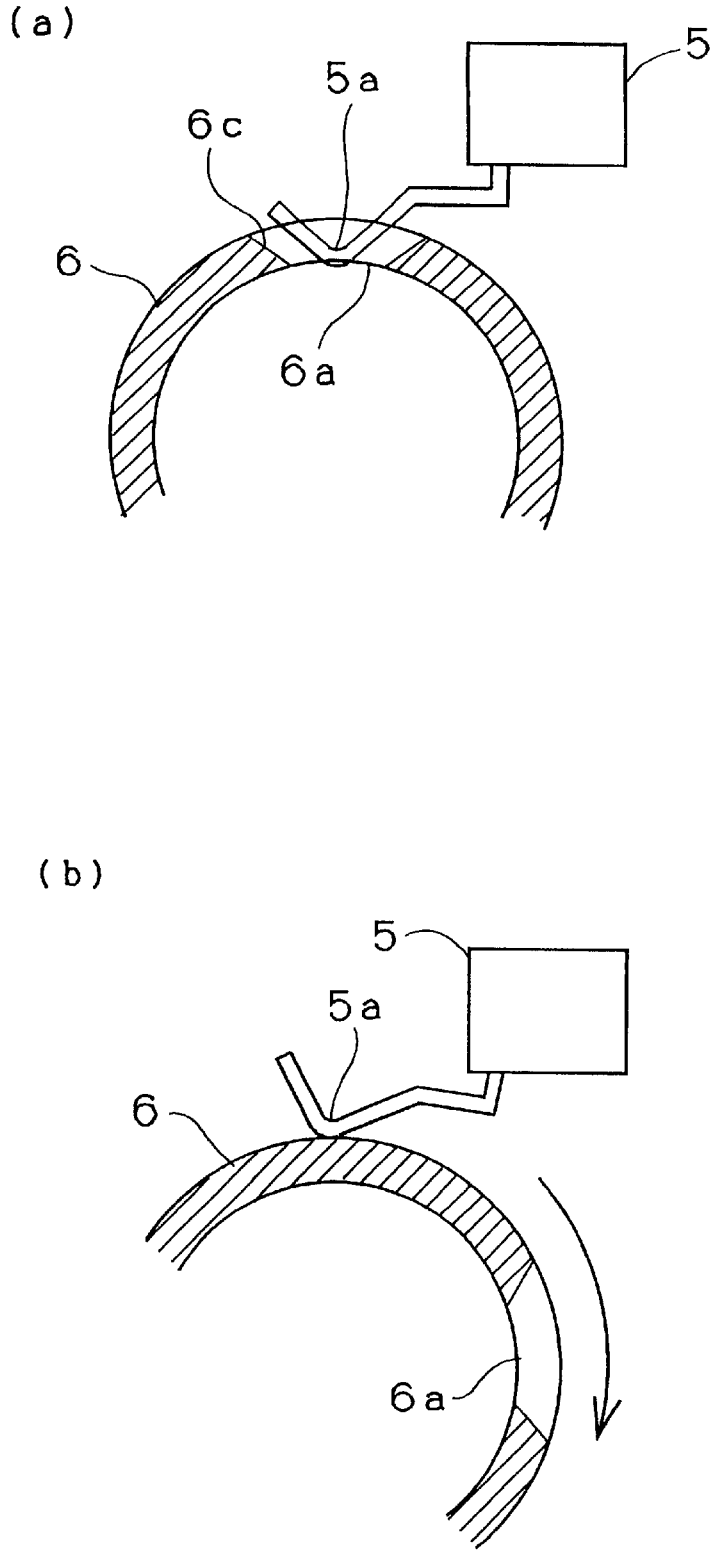
FIG. 7 is an explanatory view showing another shape of the changeover switch and that of the adapter.

Moreover, as shown in FIG. 7, if the operating section 21 of the switch 5 is disposed laterally, the operating protrusion 5*a* is formed, and the end portion 6*c* of the notch 6*a* of the adapter 6 is tapered, then the adapter 6 can be rotated while the adapter 6 is attached to the circular recess 10 and the changeover operation can be conducted without attaching/detaching the adapter 6.

Figure 8:
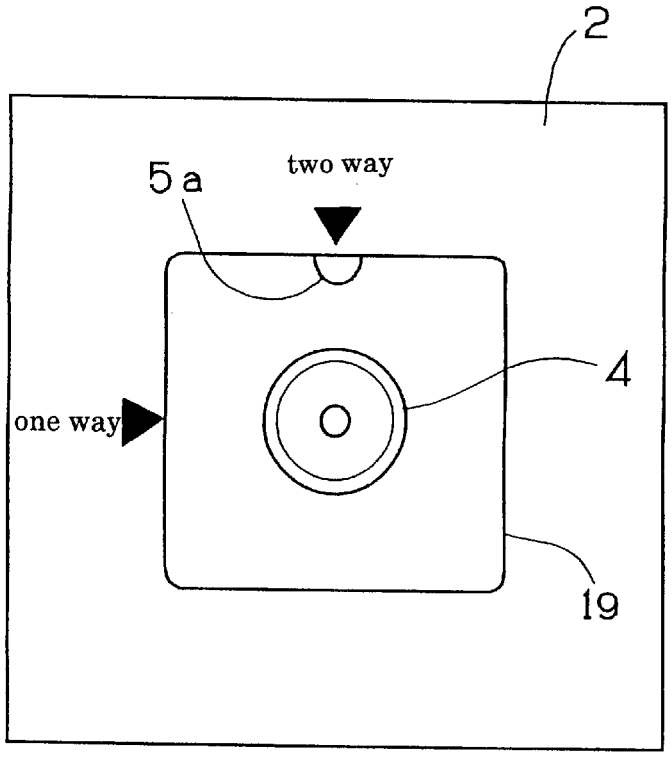
Figure 8:
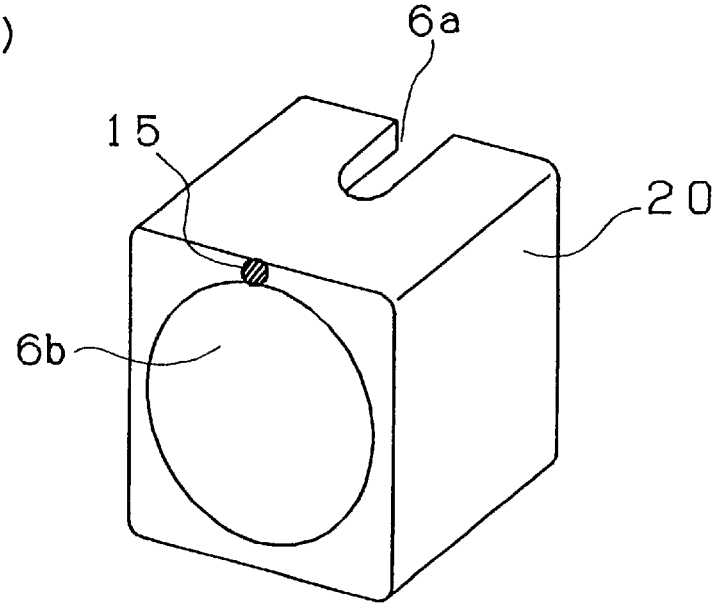

FIG. 8A shows another shape of the circular recess surrounding the F-type terminal in the embodiment stated above, e.g., a rectangular recess 19. The adapter is formed rectangularly accordingly. The recess is not necessarily formed circularly and may be the rectangular recess 19 as shown. In that case, as shown FIG. 8(*b*) an adapter 20 may be rectangular as in the case of the recess 19 and may have a circular penetrating hole 6*b* which is provided at a center thereof and into which the F-type terminal 4 is inserted. In this way, by forming the rectangular recess to restrict the insertion direction of the adapter, it is possible to easily match the position of the operating protrusion of the changeover switch to that of the non-contact region of the adapter.

As stated so far in detail, according to the invention recited in claim 1, it is possible to easily change over a unidirectional state to/from a bidirectional state by operating the changeover means without replacing a series unit main body by another.

According to the invention recited in claim 2, in addition to the advantage of claim 1, the changeover operation by the changeover means can be ensured only by inserting/detaching the adapter into/from the recess of the panel and the unidirectional state can be changed over to the bidirectional state or vice versa.

According to the invention recited in claim 3, in addition to the advantages of claim 2, the changeover by the changeover means, i.e., the changeover of the unidirectional state to/from the bidirectional state can be made by changing the insertion state of the adapter, and the adapter can be always kept attached to the series unit. Thus, there is no fear of losing the adapter.

According to the invention recited in claim 4, in addition to the advantages of claim 3, the position of the changeover switch and the direction of the adapter can be easily, visually grasped.

What is claimed is:

1. A television co-viewing series unit having a coaxial cable connection terminal provided on one of a rear portion and a side portion, a panel provided on a front surface, and an F-type terminal provided in a recess formed in the panel, the television co-viewing series unit comprising:

a high pass filter circuit; and changeover means for changing over a unidirectional state, in which said coaxial cable connection terminal and said F-type terminal are electrically connected to each other through said high pass filter circuit, to and from a bidirectional state, in which said coaxial cable connection terminal and said F-type terminal are directly connected to each other without the high pass filter circuit.

2. A television co-viewing series unit according to claim 1, wherein the changeover means is a changeover switch having an operating protrusion on a wall surface in the recess; and by inserting a generally cylindrical adapter having almost the same outer dimension as an outer dimension of said recess into the recess, said changeover switch is pressed and operational.

3. A television co-viewing series unit according to claim 2, wherein a non-contact region, which does not press the operating protrusion when the adapter is inserted into the recess, is formed on a side portion of the adapter.

4. A television co-viewing series unit according to claim 3, wherein a mark indicating and a located at a position of a front surface of the adapter near a non-contact region and a mark indicating and a located at a position of a front surface of the panel near the operating protrusion are provided, respectively.

* * * * *